US006848604B1

(12) United States Patent
Wright

(10) Patent No.: US 6,848,604 B1
(45) Date of Patent: Feb. 1, 2005

(54) CLOTHING HANGER STABILIZER

(76) Inventor: Cynthia A. Wright, 3751 Will Scarlet Rd., Winston-Salem, NC (US) 27104

( * ) Notice: Subject to any disclaimer, the term of this patent is extended or adjusted under 35 U.S.C. 154(b) by 0 days.

(21) Appl. No.: 10/085,891

(22) Filed: Feb. 28, 2002

(51) Int. Cl.[7] ..... A41D 27/22
(52) U.S. Cl. ..... 223/85
(58) Field of Search ..... 223/85, 96; 224/313, 224/927; 294/23.5; 206/284, 285, 288, 290, 291, 300, 348, 294

(56) References Cited

U.S. PATENT DOCUMENTS

| | | | | |
|---|---|---|---|---|
| 863,820 A | | 8/1907 | Wingert | |
| 1,450,416 A | | 4/1923 | Freshour et al. | |
| 1,914,840 A | * | 6/1933 | Wolff | |
| 2,498,866 A | | 2/1950 | Suhajda | 223/85 |
| 2,919,501 A | | 1/1960 | Settler | 35/56 |
| 4,130,226 A | | 12/1978 | Farrell | 223/111 |
| 4,582,233 A | | 4/1986 | Brickhouse | 223/88 |
| 4,871,154 A | | 10/1989 | Seney | 269/97 |
| 5,002,210 A | * | 3/1991 | Kolton et al. | |
| 5,074,447 A | * | 12/1991 | Kolton et al. | |
| 5,180,057 A | * | 1/1993 | Franklin | 206/279 |
| 6,095,580 A | | 8/2000 | Crocker | 294/19.1 |

* cited by examiner

*Primary Examiner*—Rodney M. Lindsey
*Assistant Examiner*—James Smith
(74) *Attorney, Agent, or Firm*—Womble Carlyle Sandridge & Rice, PLLC

(57) ABSTRACT

A device for supporting and stabilizing a clothing hanger so that a user employing only one extremity can position a hanger thereon for hanging or removing an article of clothing without other assistance, comprising a base and a hanger receptacle that is configured and adapted to receive and stabilize a clothing hanger.

7 Claims, 5 Drawing Sheets

CLOTHING HANGER STABILIZER

FIELD OF THE INVENTION

The present invention relates to the field of hanger or support devices for securing clothing, and, more particularly to a clothing hanger stabilizer that enables users to hang clothing thereon or remove clothing therefrom using only one extremity.

BACKGROUND OF THE INVENTION

Physically-challenged persons face a myriad of obstacles on a daily basis that most non-handicapped persons take for granted. Simple tasks that are taken as routine and without a great deal of thought or planning by people require considerable effort and forethought on the part of those without complete use of their bodies. In many instances, these daily tasks are impossible to complete. As a result, such persons often require human assistance in performing such tasks, which reduces independence.

Over the years, a variety of devices have been conceived and developed for assisting physically-challenged persons in per-forming various functions. Such devices have been directed to mobility, lifting, reaching, holding, and personal hygiene. Devices to assist handicapped persons in donning certain items of apparel, and numerous items of apparel have been developed specifically for individuals having certain infirmities are also known.

A clothes hanger for handicapped persons is known, but this device is simply a hanger-shaped implement with an extension handle. It is intended for persons with the use of a both upper limbs, but who are confined to wheelchairs and cannot reach hangers supported on conventional closet rods. Such devices, however, do not address the problem associated with using conventional clothes hangers by a person without the full use of both arms or hands.

SUMMARY OF THE INVENTION

The present invention is directed to a simple, yet economical and aesthetically-pleasing clothing hanger stabilizer that addresses the problems described above.

In a preferred embodiment, the present invention comprises a clothes hanger stabilizing and holding device for conventional clothing hangers that permits a person without full a use of both hands, or one who is using one hand to perform a separate task, to position such a hanger and to hang or remove clothing from the hanger. In its simplest construction, the stabilizing and holding device includes a base having a hanger-stabilizing receptacle.

The base of the device is adaptable for mounting at a height that is convenient and easily accessible to the user. While the base may be mounted on a post, pedestal, or item of furniture, it is desirably adapted for mounting on the vertical surface of a wall or a door, much like a picture frame. In one embodiment, the mountable base is a rectangular-shaped block having a mounting surface and a hanger-receiving side. The mountable side includes provisions for attaching or hanging the device such as keyhole fasteners, lugs, and the like, but may be mounted with any conventional fasteners. The mountable base need only be mounted so that it is stable and not easily loosened when used.

The hanger stabilizing side of the base faces inward toward the user. A hanger receptacle is formed, cut, or connected to the stabilizing side of the base. In a preferred embodiment, the hanger stabilizing side resembles a box-like shape with an arcuate, hook-shaped groove formed therein. Constructed in this manner, the hook portion of a conventional clothing hanger can be placed in the groove. Once positioned within the groove, a knob portion, bounded on the lower side by the groove, supports the weight of the hanger and any clothing hanging thereon. Desirably, this knob portion includes a lip, or rim, to prevent the hook of the clothing hanger from sliding forward off of the knob. The arcuately-shaped groove, in combination with the knob portion, serves to stabilize the clothing hanger. Thus, when placed over the knob portion and with the hook situated within the groove, a conventionally shaped hanger is restrained from substantial lateral movement within the plane that is parallel to the wall on which the base is mounted. The hanger, then, will not rock about the knob portion. The extent of movement of the hanger will, however, depend upon the size and geometry of the particular hanger and the width of the groove formed in the base.

Unlike so many other devices for use by physically-challenged individuals that limit the holding of only a single item, the device of the present invention allows a physically-challenged or restrained person to sequentially position hangers on the base one at a time while dressing or undressing. For instance, a hanger may be positioned in the base, an article of clothing hanged thereon, and the hanger removed and placed in a closet, or vice versa. All of these steps may be performed with the use of only one extremity.

Another aspect of the present invention is to provide a device for stabilizing a clothing hanger that includes a cover for preventing forward movement of a hanger and that also may be decorative. The base and receptacle combination described above, therefore, also includes a cover that is adapted to cover the stabilizing side of the base, and the arcuate groove, in articular. In one preferred construction, the cover is dimensioned to hingedly fit over the ace, or stabilizing side, of the base. Preferably, the back of the front cover securely latches to the base by means of a magnetic catch, or other easily manipulable latching mechanism. The cover performs at least two functions; it assists in preventing the hanger hook from sliding off of the base, and it may perform an ornamental function so that the underlying base is essentially hidden from view. The cover then may even comprise an ornamental picture frame or other holder for memorabilia.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
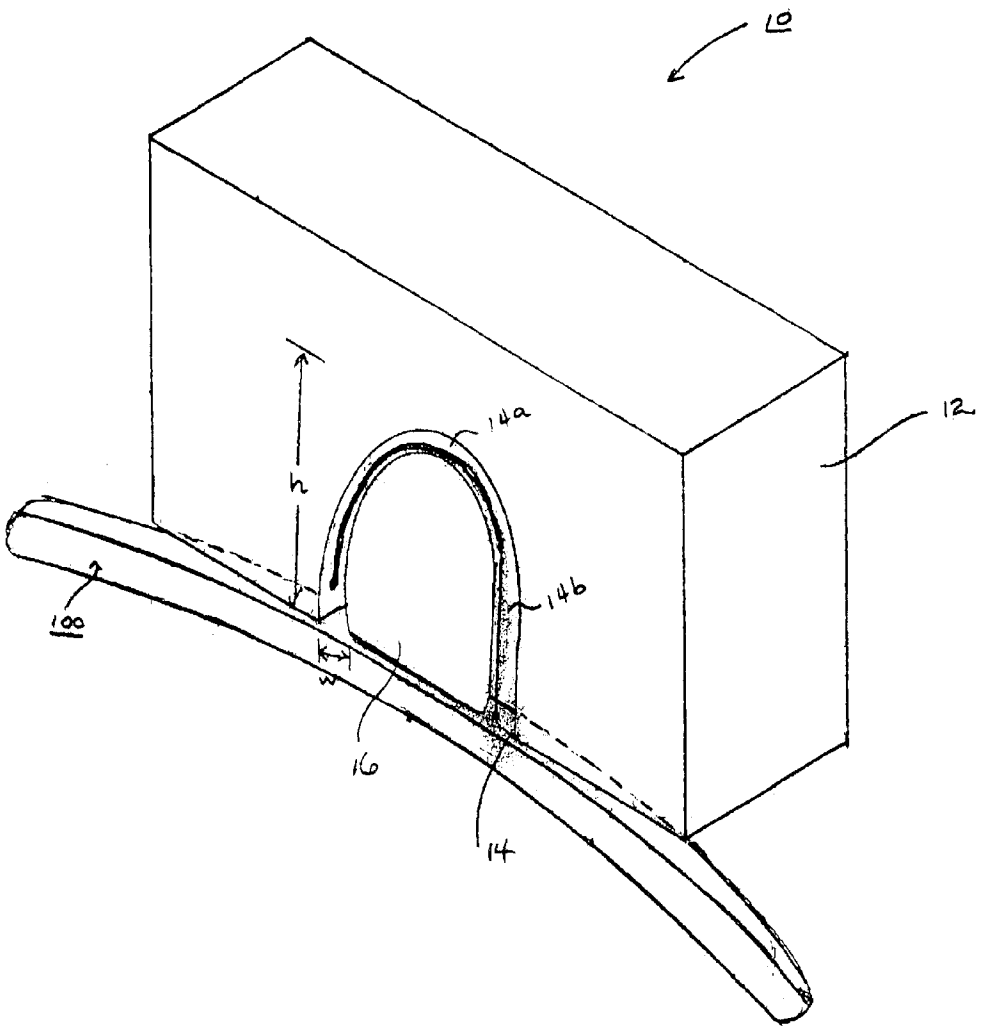
FIG. 1 is a front perspective view of the present invention.

As shown in FIG. 1, one embodiment of the present invention is directed to a clothing hanger stabilizing device, shown generally as 10. The device, in its simplest construction, includes a mountable base 12 having a hanger-stabilizing receptacle, or knob, 16 thereon.

While the mountable base 12 is shown as a generally-rectangular box, its geometry is not limited thereto. Rather, the mountable base 12 may be constructed in an almost unlimited number of shapes and sizes. The mountable base 12 must be mountable to either a firm surface, such as a wall, or other sufficiently stable platform, pedestal, etc., and must be capable of holding and supporting a conventional type clothing hanger described hereinbelow. The mountable base 12 may be formed from a solid piece of stock material, such as wood, or may be metallic, plastic, etc. There is no requirement that the base be of a solid construction so long as it is sufficiently stable and rigid. The material type is also not critical to the present invention; it is desirable, however, that the material chosen be sufficiently durable to provide a long service life comprising thousands of usages.

A groove 14 is formed in the mountable base 12. The groove 14 conforms generally in dimension to the hook portion of a conventional clothing hanger. That is, groove 14 has an arcuate, or hook, portion 14*a*, and a generally straight neck portion 14*b*. As those skilled in the art will appreciate, the size and shape of groove 14 should be chosen to adapt to the range of hanger hooks and necks that might be anticipated for use with the stabilizing device 10. For instance, some hangers have longer hook portions, or neck portions that are larger than a conventional wire hanger. As shown in FIG. 1, the device of the present invention may have a groove 14 having a width "w" of sufficient dimension to accommodate hangers of different sizes, and a height "h" of sufficient dimension to accommodate hangers with differing neck lengths.

Figure 2:
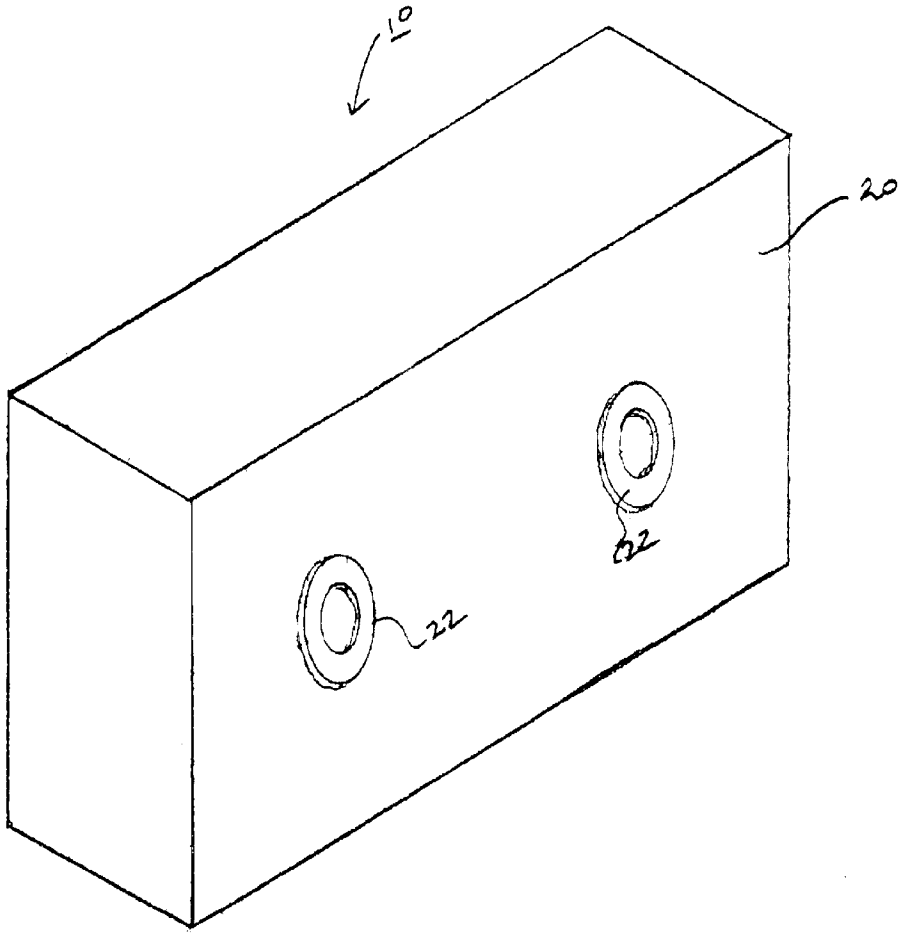
FIG. 2 is a rear perspective view of the present invention.

Turning now to FIG. 2, the hanger stabilizing device 10 is preferably mounted on a vertical surface such as a wall or a bedroom, closet, etc. The rear, or back, side of the mountable base 12 is generally planar and provided with a means for mounting the base to the vertical surface, such as, for example, mounting hardware hangers 22. Hangers 22 may be keyhole fasteners, lugs, or any other commercially available hangers or mounting hardware for mounting base 12 on a substantially vertical surface. Alternately, one or more grooves may be formed in side 20 for engagement with wall-mounted hardware. Those skilled in the art will appreciate that there are numerous ways to mount a base 12, so long as the base 12 is mounted in such fashion that it will remain stable and not be easily loosened when a user thereof places a clothing hanger thereon, and removes clothing from the hanger. For instance, base 12 may also be mounted on a pedestal (not shown) that provides sufficient stability for its expected service.

Figure 3:
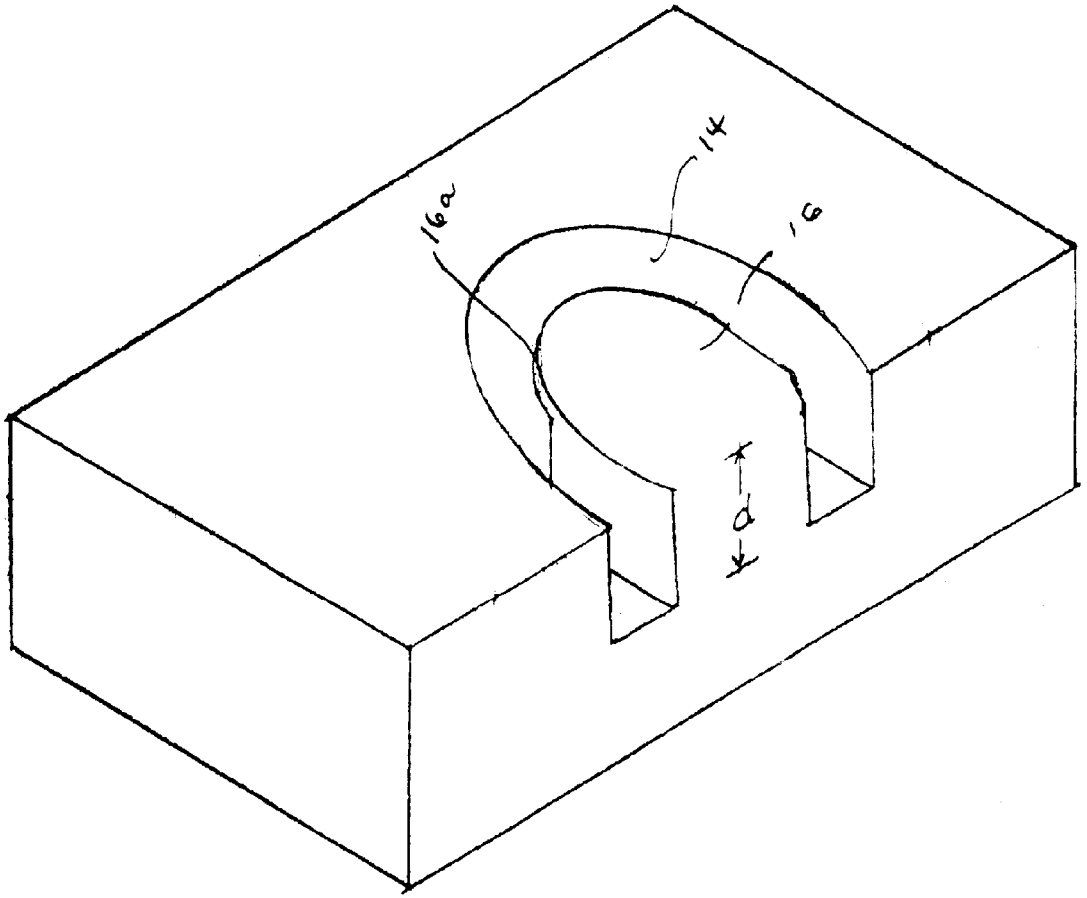
FIG. 3 is a bottom perspective view of the present invention.

Referring now to FIG. 3, a bottom perspective view of the hanger stabilizing device is shown to better illustrate the stabilizing features of the device 10. With respect to hanger receptacle 16, FIG. 3 illustrates how a groove 14, defines the hanger receptacle. Groove 14 is not limited to a specific depth "d", but should be sufficiently deep to accommodate hangers having a range of thicknesses, and should be sufficiently deep to prevent a hanger 100 from slipping therefrom receptacle 16 when a user attempts to hang clothing thereon. Receptacle 16 desirably includes a rim portion 16*a* that will prevent a hanger from slipping forward from receptacle 16.

Figure 4:
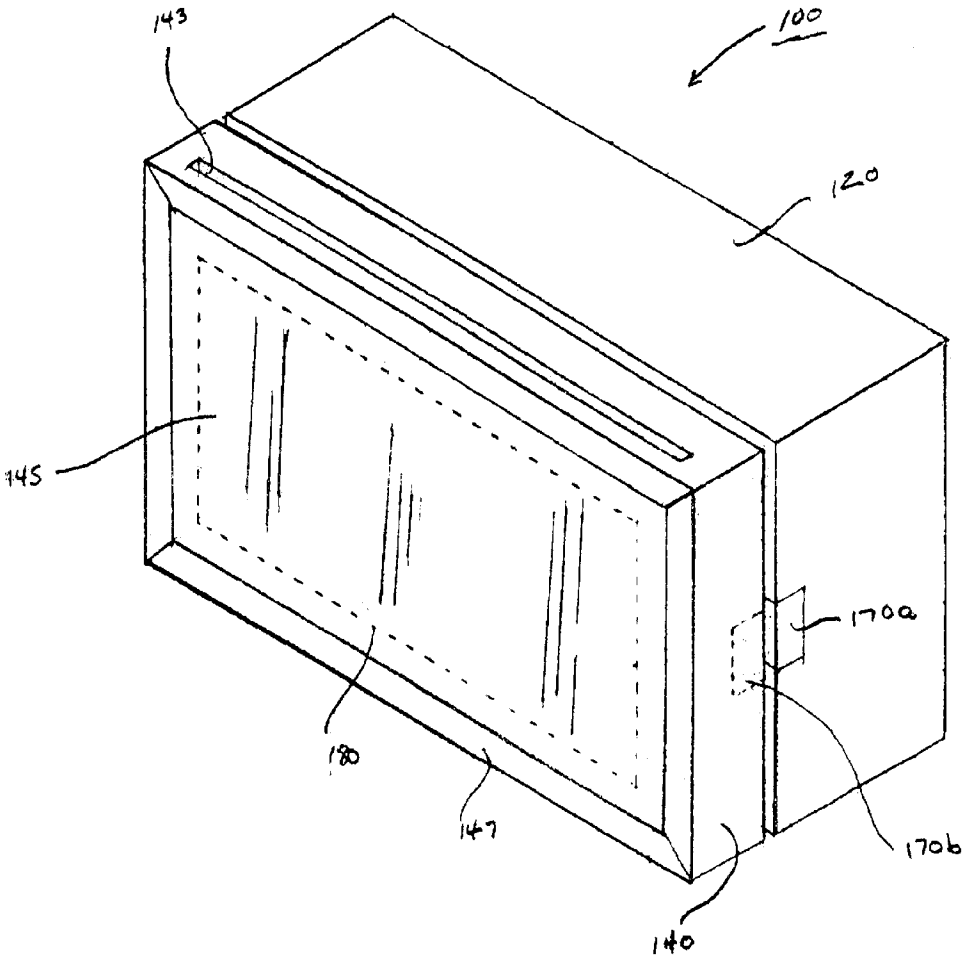
FIG. 4 is a front perspective view of an alternative embodiment of the present invention.
Figure 5:
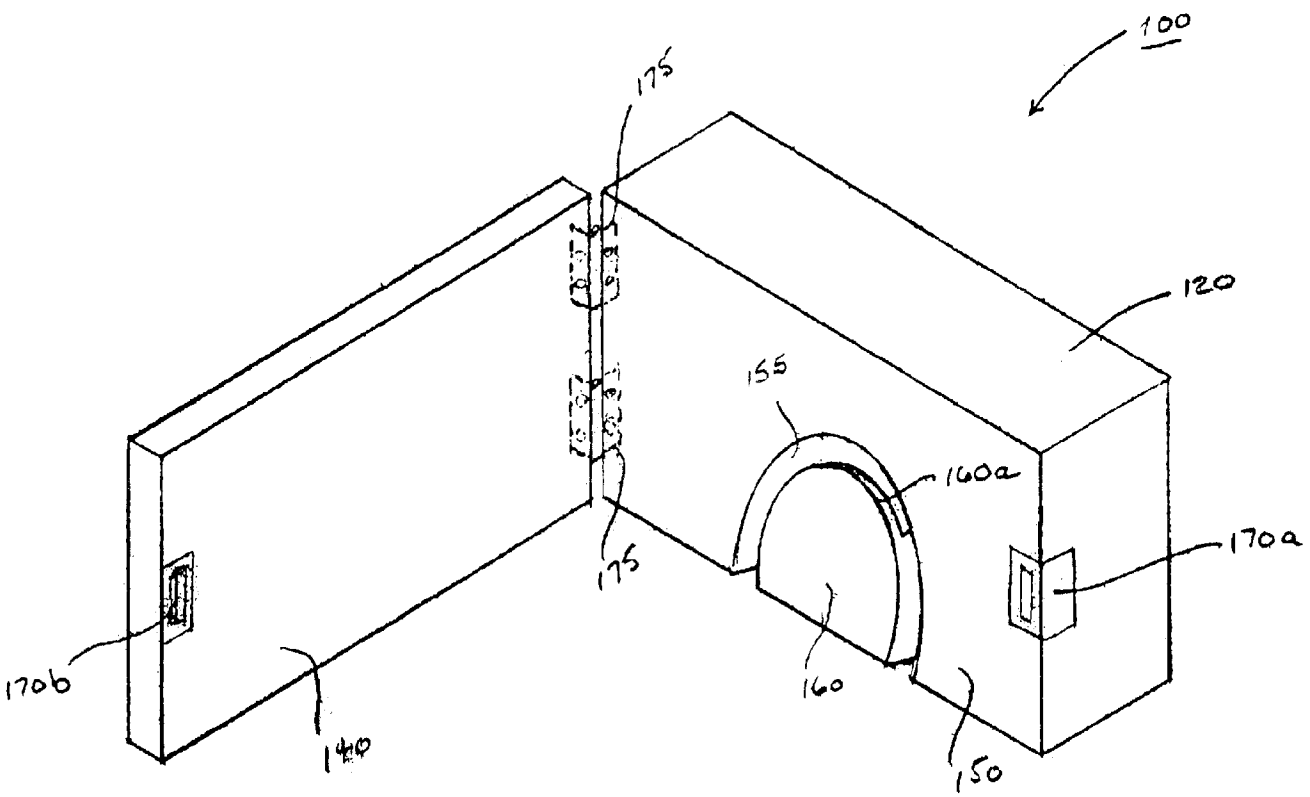
FIG. 5 is a front perspective view of the embodiment of FIG. 5 with the cover in the open position.

Turning now to FIGS. 4 and 5, a further embodiment of the hanger stabilizing device, shown generally as 100, includes a base 120 and a front cover 140 that is hingedly attached to the base 120. The base 120 is the same in all respects as base 12 described above, with the exception of the cover 140 and hardware associated therewith as described below. Front cover 140 generally conforms in dimension with the front face 150 of base 120 and is hingedly attached to one end of base 120 with conventional hinges 175. Front cover 140 could alternately be hinged to the opposite end of base 120 based on the desires and physical limitations of the particular user. Similarly, hardware other than hinges could be employed; e.g., front cover 140 could easily be made to slide into place over the front face 150 of base to 120. To hold the front cover 140 in a closed position, a magnetic catch 170*a* is mounted on, or recessed in, the face 150 of base 120. The corresponding catch plate 170*b* is mounted on the back side of front cover 140. Other catches or latches conventionally known in the art will also be suitable provided they can be manipulated by using only one extremity.

The front cover 140 of the hanger stabilizing device 100 serves at least two functions. When in the closed position, front cover 140 adds additional stability in preventing movement of a clothing hanger and in preventing the hanger from slipping off of receptacle 160. Additionally, front cover 140 serves to conceal the face of base 120 from direct view and may be so formed as to present a decorative appearance, when installed. As best seen in FIG. 4, the front cover 140 may be constructed like a picture frame so that pictures or other memorabilia 180 may be positioned therein. In the embodiment shown in FIG. 4, the front cover 140 includes a frame portion 147. While not required, a glass or plastic panel 145 is mounted within the frame portion 147. While access to insert pictures and the like may be provided on the back of front cover 140, a slot 143 is provided in the top of front cover 140 for easy insertion of the chosen picture or memorabilia 180.

Although the present invention has been described with a preferred embodiment, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A device for holding and stabilizing a clothing hanger wherein a user employing only one upper extremity may position a hanger thereon for hanging or removing an article of clothing without other assistance, comprising:

(a) a base adaptable for mounting at a height accessible to a user;

(b) a hanger receptacle formed on said base, said hanger receptacle configured and adapted to receive and hold a conventional clothing hanger, and wherein the base and the hanger receptacle are cooperatively positioned with respect to one another as to prevent a hanger received thereon the hanger receptacle from lateral movement, and (c) a cover adapted to overlay the hanger receptacle, wherein the cover comprises a decorative frame.

2. The device of claim 1 wherein the decorative frame is adapted to hold a visual image.

3. The device of claim 1 wherein the base is is formed for mounting on a vertical surface.

4. The device of claim 1 wherein the base is so formed for mounting on a vertical surface.

5. The device of claim 1 wherein the hanger receptacle is ovally-shaped and configured to receive the hook and neck portions of a clothing hanger.

6. The device of claim 1 wherein the cover portion is hingedly attached to the base.

7. The device of claim 1 further including a latch for holdings the cover in closed relation to the base.

* * * * *